US006464184B1

(12) United States Patent
Lytle

(10) Patent No.: US 6,464,184 B1
(45) Date of Patent: Oct. 15, 2002

(54) APPARATUS FOR RETAINING A CANISTER

(76) Inventor: Brian E. Lytle, 85 Fifth Ave. #16, Paterson, NJ (US) 07524

( * ) Notice: Subject to any disclaimer, the term of this patent is extended or adjusted under 35 U.S.C. 154(b) by 0 days.

(21) Appl. No.: 09/594,672

(22) Filed: Jun. 16, 2000

Related U.S. Application Data

(63) Continuation-in-part of application No. 09/132,786, filed on Aug. 13, 1998, now abandoned.
(60) Provisional application No. 60/055,649, filed on Aug. 14, 1997.

(51) Int. Cl.[7] ..... A47G 29/00; A47G 23/02
(52) U.S. Cl. ..... 248/126; 248/146; 248/149; 248/346.01; 248/154
(58) Field of Search ..... 248/126, 146, 248/149, 152, 150, 154, 156.1, 310, 316.8, 174, 346.06, 346.01, 346.07, 510, 500, 460, 495, 439, 440, 440.1, 188.6; 108/132, 133; 220/700, 695; 223/116

(56) References Cited

U.S. PATENT DOCUMENTS 1,133,109 A * 3/1915 Derbyshire ..... 108/132
1,828,249 A * 10/1931 Hammond ..... 248/154
2,112,155 A * 3/1938 Haney et al. ..... 248/149
2,287,919 A * 6/1942 Ulzheimer ..... 211/85.4
2,576,832 A * 11/1951 Gibson ..... 248/149
2,750,140 A * 6/1956 Smith ..... 248/154
2,751,177 A * 6/1956 York ..... 248/146
2,851,185 A * 9/1958 Taylor ..... 248/346.04
2,959,387 A * 11/1960 Ficek ..... 248/149
3,061,969 A * 11/1962 Lunday ..... 248/448
3,271,075 A * 9/1966 Good ..... 297/423.41
3,414,311 A * 12/1968 Trimboli ..... 294/34
3,805,711 A * 4/1974 Lakso ..... 103/133
4,010,699 A * 3/1977 Lakso ..... 108/133
4,398,690 A * 8/1983 Rutledge ..... 248/150
4,693,440 A * 9/1987 Lalonde ..... 248/154
4,877,208 A * 10/1989 Kennard, Jr. ..... 248/146
4,998,696 A * 3/1991 Desjardins ..... 248/146
5,028,023 A * 7/1991 Allen ..... 248/152
5,232,188 A * 8/1993 Troncone ..... 248/154
5,383,411 A * 1/1995 Tomaka et al. ..... 108/129
5,553,824 A * 9/1996 Dutra, Jr. ..... 248/346.07

* cited by examiner

*Primary Examiner*—Anita King
(74) *Attorney, Agent, or Firm*—Moser, Patterson & Sheridan LLP

(57) ABSTRACT

Apparatus for retaining a canister having an adjustable base and at least one swing member attached to the base and preferably two swing members attached to the base opposite each other. The base further has a spring member disposed thereupon and in contact with the swing member to keep the swing member in a first open position. The swing member has a first end that is rotatably attached to the base via a hinge member and a second end that has a semicircular recess formed therein. The base is adjustable to provide an adjustable range of motion of the swing member with respect to the base. In operation, the apparatus moves from a first open position to a second closed position upon application of a force upon the swing members to retain a canister placed between the swing members. Use of the apparatus results in no temporary movement or constricting of a worker's limbs which can cause imbalance or injury nor requires a second person to stabilize the canister.

4 Claims, 8 Drawing Sheets

APPARATUS FOR RETAINING A CANISTER

This patent application is a continuation-in-part of U.S. patent application Ser. No. 09/132,786, filed Aug. 13, 1998, now abandoned, which claims benefit of U.S. provisional patent application serial No. 60/055,649, filed Aug. 14, 1997 the disclosure of each of which is incorporated herein by reference.

BACKGROUND OF THE DISCLOSURE

1. Field of the Invention

The invention is directed to apparatus for retaining cans and more specifically to a spring loaded clamp for retaining multi-gallon sized cans without restricting the movements of an operator of said clamp.

2. Description of the Background Art

In virtually every aspect of construction, from the building of skyscrapers to do-it-yourself home repairs, some type of liquid material is used to accomplish a specific project. For example, paints, wood stains, adhesives, caulking sealants, joint compounds and the like are all liquid (or semi-liquid) materials that are packaged in cans ranging in sizes from a few ounces to five gallons. Usually when opening such packaging, only a small portion of the material within is immediately required yet the entire package must be handled in preparation of application (i.e., stirring a can of adhesive, scooping a desired amount of sealant, compound or the like).

Handling the can is sometimes awkward as it tends to shift under forces caused by stirring or scooping. Compensating for these forces subsequently creates further awkwardness as the weight of the can has changed due to the decrease in material. As such, the can slides across a floor, tabletop or other support surface which causes spillage, waste, lost time and effort. A natural reaction by a worker acquiring the material in the can is to buttress the can against his hand, foot or other body part and a neighboring wall or heavy object. This condition requires that the worker constantly apply pressure to the can (i.e., pushing the can against a wall) while obtaining the material which can cause fatigue, cramp or loss of balance should he lose his footing. Such dangers cannot be tolerated in a construction environment or in the home for obvious reasons of serious personal injury and/or property damage. As such, there is a need in the art for securing liquid containing vessels in a repeatable and unconstricting manner to facilitate a worker's task.

Thus, there is a need in the art for an apparatus that can retain a can without restricting use of limbs or causing an imbalance condition of a worker acquiring the material in said can. Said apparatus should be sturdy and capable of repeating retention many times without a reduction in expected results.

SUMMARY OF THE INVENTION

The disadvantages heretofor associated with the prior art are overcome by the present invention of an apparatus for retaining a canister having an adjustable base and at least one moveable swing member attached to said base and at least one stationary swing members attached to said base opposite each other. The base further has a spring member disposed thereupon and in contact with said swing member to keep said swing member in a first open position. The swing member has a first end that is rotatably attached to the base via a hinge member and a second end that has a semicircular recess formed therein. The base is adjustable (e.g., having an expansion adjuster provided thereon to provide an adjustable range of motion of the swing member with respect to the base. The swing member may optionally have a textured surface such as a plate secured to the swing member or louvers formed thereon. In operation, the apparatus comes into a second closed position upon application of a force upon said swing members. In an alternate embodiment of the invention, one of the swing members is stationary and the other is rotatably affixed to the base and provided with a spring member.

With the invention as described above, a worker can prepare construction materials such as liquid or semi-liquid materials (adhesives, caulk, sealants and the like) from a large volume canister. The preparation can be carried out without temporary movement or constricting of limbs which can cause imbalance or injury or requiring a second person to stabilize the canister to complete the task. As such, worker safety is improved and the risk of spillage or waste of construction materials is greatly reduced.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
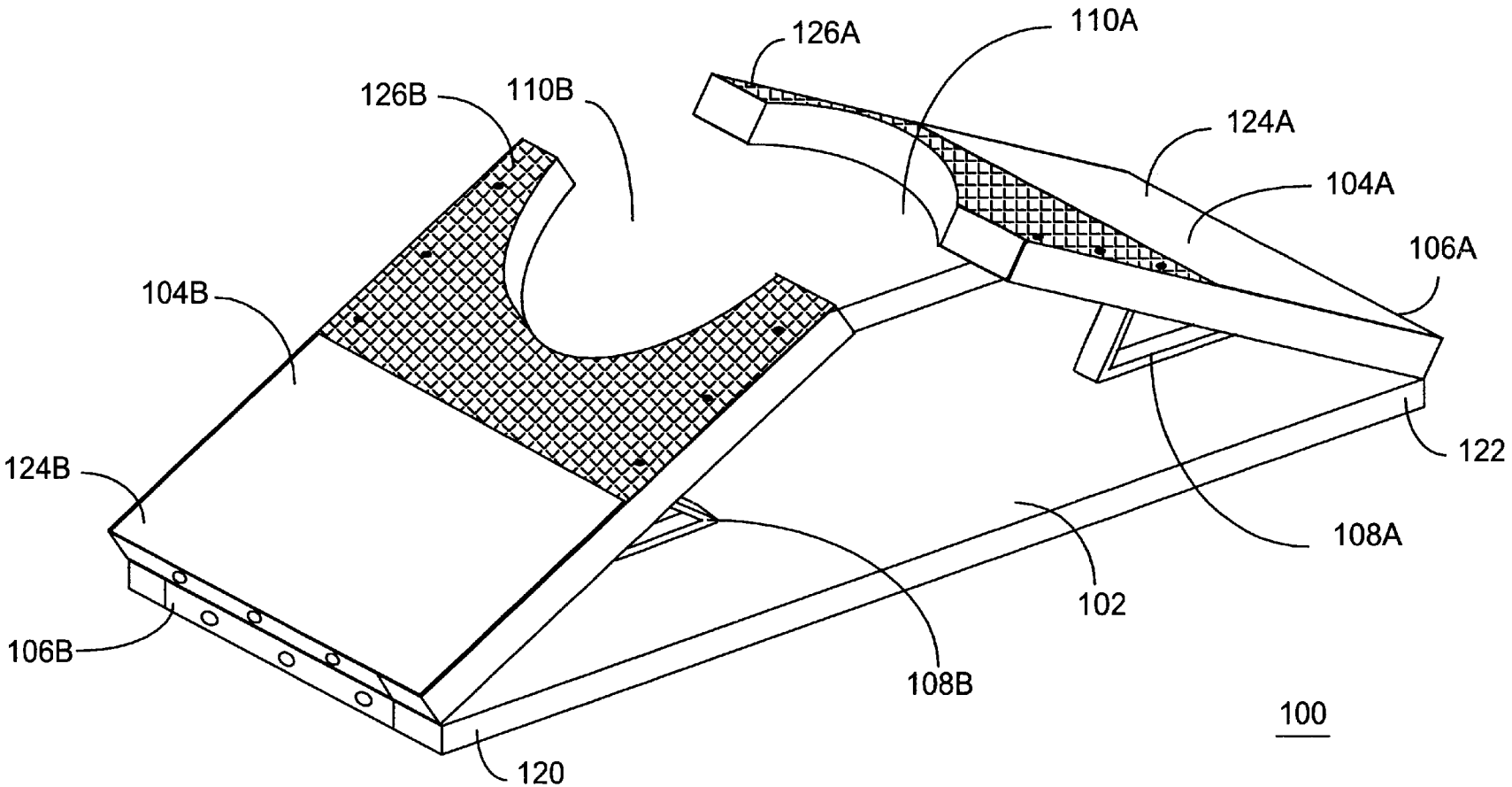
FIG. 1 is a perspective view of a canister clamp in accordance with subject invention.
Figure 2:
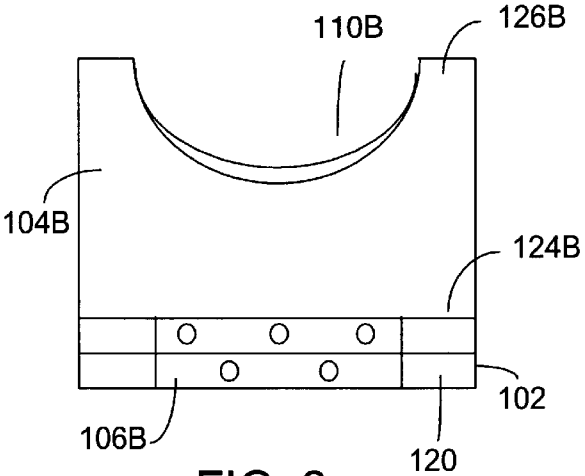
FIG. 2 is a side elevation view of the subject invention.

The subject apparatus is a canister retainer or can clamp as depicted in FIG. 1. FIG. 2 depicts a side elevation view of one embodiment of the apparatus 100 further showing the arrangement of the base 102 and one of the swing members 104B and features of the same. For a complete description, the reader should refer to FIGS. 1–4 simultaneously. Specifically, the can clamp 100 comprises a base 102 for supporting a canister or similar vessel (not shown). Attached to the base 102 are one or more swing members (specifically first swing member 104A and second swing member 104B) for retaining the canister or similar vessel in a stationary position. The swing members 104A and 104B are rotatably attached to the base 102. Specifically, one or more hinge members 106A (obscured by swing member 104A) and 106B respectively are attached to the swing members 104A and 104B and base 102. The base 102 further has one or more spring members 108A and 108B or other similar type of tensioning devices positioned under swing members 104A and 104B respectively for retaining the swing members in a first open position. Alternately, the spring members are incorporated into the hinge members to form a spring loaded hinge member. The base 102 and swing members 104A and 104B are fabricated from a durable material such as but not limited to wood (e.g., plywood) and sheet metal.

In greater detail, the base 102 has a first end and a second end 120 and 122 respectively. Swing member 104A likewise has a first end 124A and a second end 126A. The first end 124A of swing member 104A is attached to the second end 122 of base member 102 via the hinge member 106A. The second end 126A of swing member 104A has a semicircular cutout 110A to accommodate a portion of a canister or similar vessel. In similar fashion swing member 104B has a first end 124B and a second end 126B. First end 124B of swing member 104B is attached to the first end 120 of base 102 via hinge member 106B. Second end 126B of swing member 104B is also provided with a semicircular cutout 110B to further accommodate a canister or similar vessel.

Figure 3:
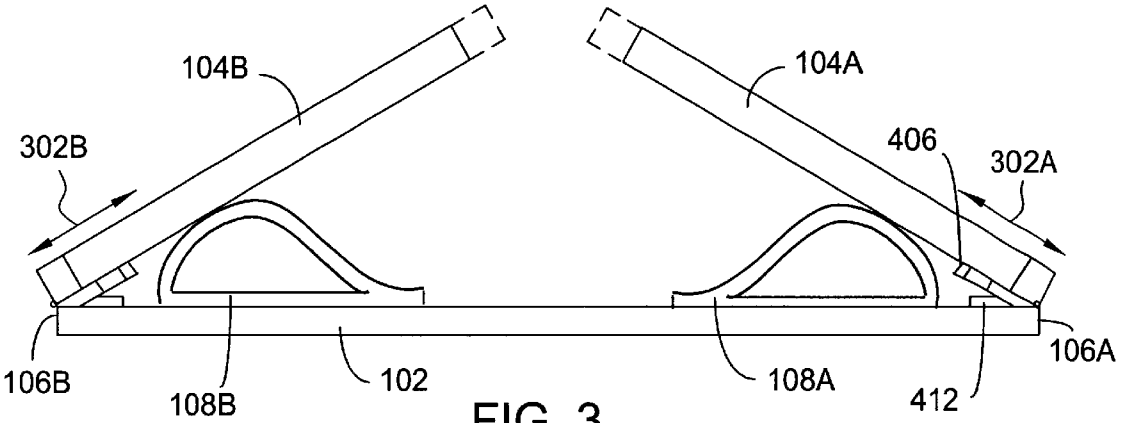
FIG. 3 is a front elevation view of the subject invention.

FIG. 3 shows a front elevation view of the subject apparatus 100 further comprising an alternate embodiment for the hinge members 106A and 106B. Specifically, hinge members 106A and 106B can be adjustable so as to allow movement along a plane 302A defined by swing member 104A. Likewise hinge member 106B can provide movement upon a plane 302B for hinge member 104B. Adjustability of the swing members 104A and 104B along the direction of the arrows 302A and 302B respectively allow the swing members to accept various sizes of canisters or similar type vessels.

Figure 4:
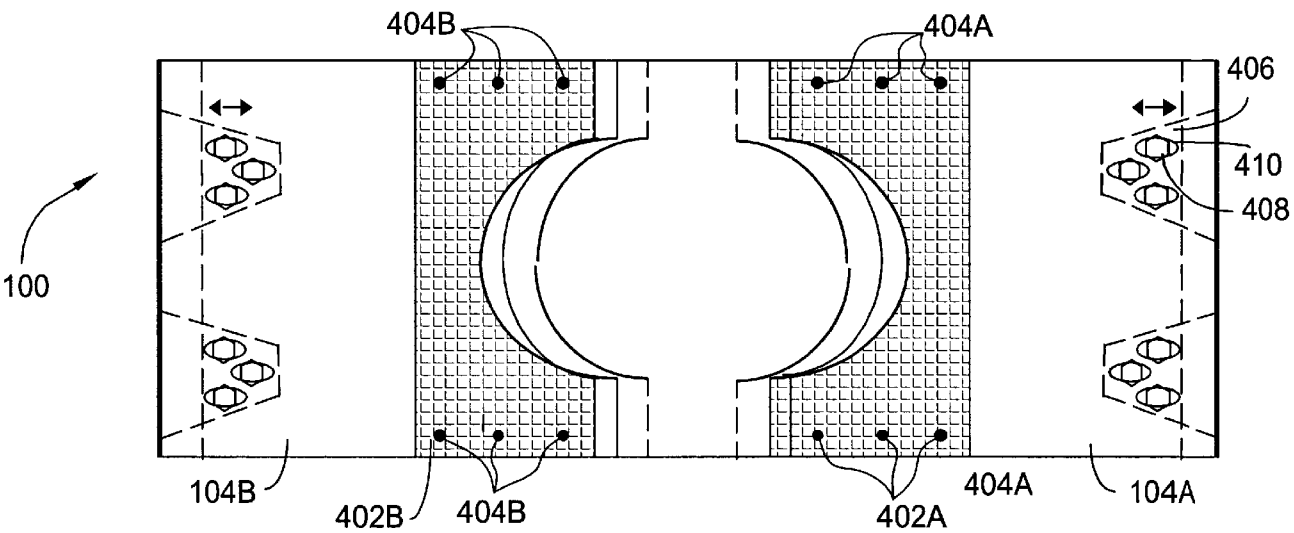
FIG. 4 is a top view of the subject invention.

FIG. 4 shows a top view of the subject apparatus 100 showing the alternate embodiment of the hinge members 106A and 106B. Specifically, one or more first hinge plates 406 are disposed beneath swing member 104A and 104B (hinge plates 406 are shown in phantom). The swing members 104A and 104B are secured to the hinge plates 406 by any known means for securing including but not limited to screws, bolts, or the like that allow for temporary unfastening or adjusting of said fasteners 408 along a groove or slot 410 provided in the hinge plate 406. That is, unfastening member 408 allows the swing members 104A and 104B to travel along the path of the slot 410 to alter the size of the recessed portion 110A and 110B respectively to accommodate various different size canisters. The dashed outline shown in FIGS. 3 and 4 of swing members 104A and 104B show an example of a range of motion allowable along planes 302A and 302B respectively upon adjusting swing members 104A and 104B against hinge plates 406. Additionally, second hinge plates 412 are disposed upon the base 102 and secured thereupon so as to restrict any unintended lateral movement of the swing members 104A and 104B.

An additional feature shown in FIG. 4 is a textured surface 402A and 402B of the swing members 104A and 104B respectively. Specifically, a textured surface may be applied to the swing members and secured to same via fasteners 404A and 404B. Such textured surface reduces the likelihood of slippage or loss of a footing when operating the apparatus as explained below. In the depicted embodiment of FIG. 4, the textured surface extends from the second end 126A and 126B of swing members 104A and 104B respectively to approximately half way along said swing members. For example, a suitable surface texture treatment can include a grit treated resin applied to the swing members (for example applied over the plywood swing members) or louvers formed into the surface of the swing members (for example incorporated into the sheet metal swing members). Alternatively, the textured surface may fully cover swing members 104A and 104B to provide optimal footing surface when operating the apparatus 100.

Figure 5:
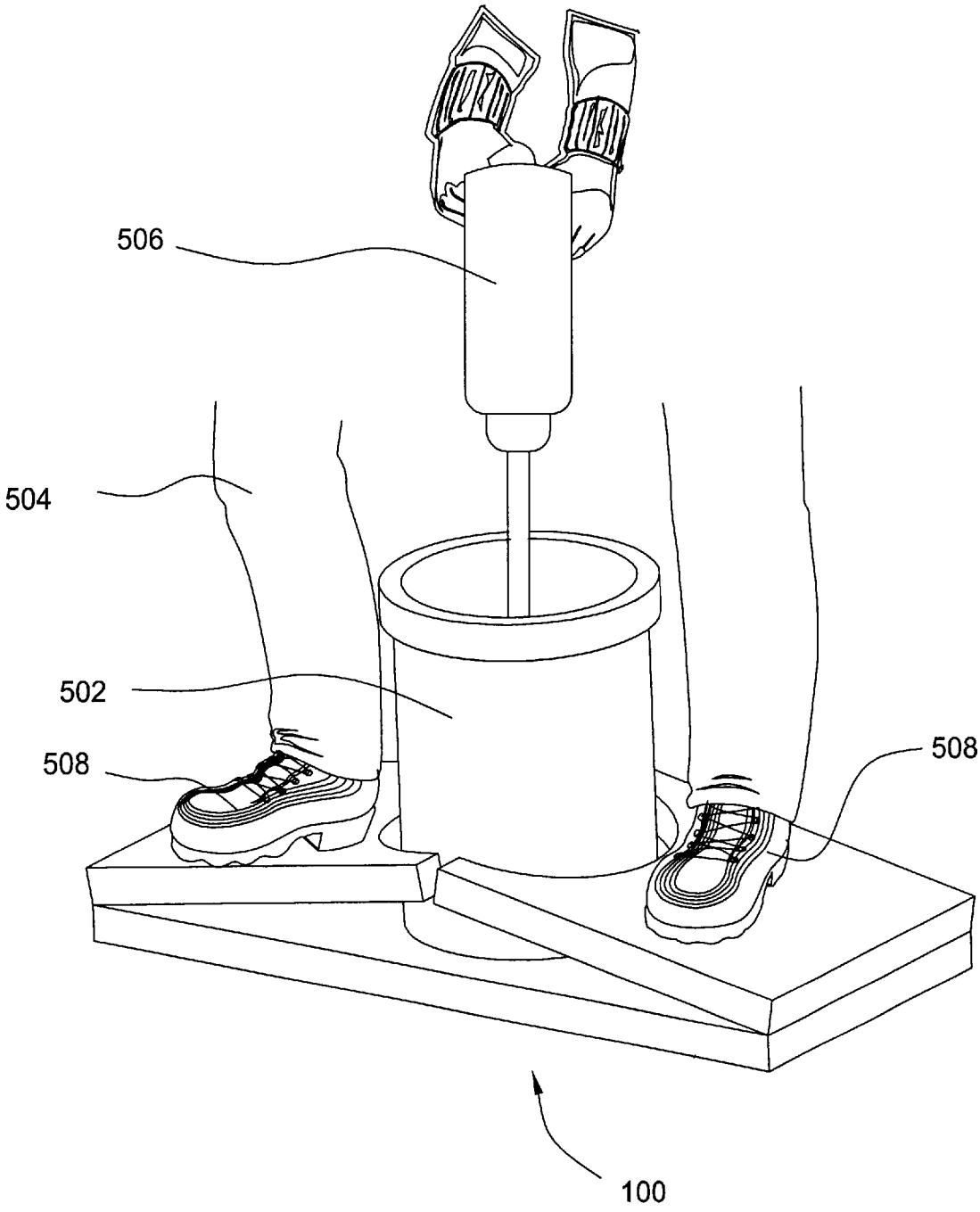
FIG. 5 is a partial front perspective view of the subject invention in use.

FIG. 5 depicts a partial front elevation view of the apparatus 100 in operation. Specifically, a canister 502 (i.e., a 2.5 gal can of caulking material) is inserted into the semicircular recessed portions 110A and 110B formed into members 104A and 104B respectively. That is, the two semicircular openings 110A and 110B form a circular opening that is suitable for accommodating the canister 502. Next, a caulking gun operator 504 applies pressure to the swing members 104A and 104B by standing on the swing members with his feet 508. The downward pressure applied by the operator 504 presses the swing members 104A and 104B into contact with the canister 502 thereby securing it both horizontally and vertically. With the can clamp in this second closed position, the operator 504 is able to easily accomplish tasks with the can (e.g., stirring it by way of a manual or electric stirrer 506 or refilling a bulk caulking gun). There is no need for stabilizing the can 502 with operator's hands or other limbs or body parts or for a second person that may otherwise compromise operator balance or safe operation during performance of the task.

Figure 6:
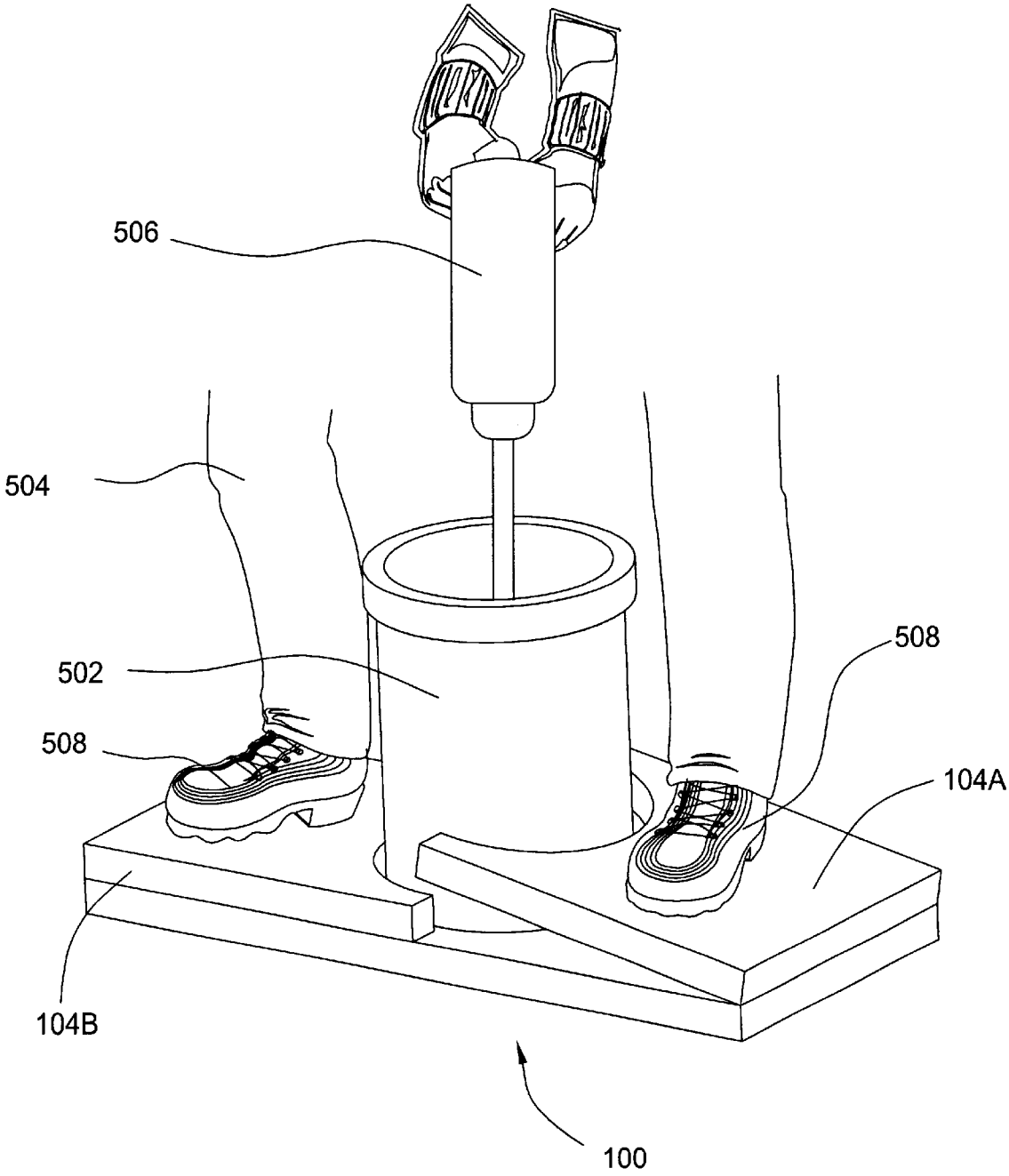
FIG. 6 is a partial front perspective view of an alternate embodiment of the subject invention in use.

In an alternate embodiment of the subject invention shown in FIG. 6, only one member is moveable (e.g., swing member 104A), and the other member is stationary (e.g., stationary member 104B is secured to the base and does not contain a spring member or other similar device for tensioning). In this second embodiment, the operator 504 needs only apply pressure to the tensioned swing member 104A to secure the canister 502 against the stationary member 104B. Although use of this invention has been discussed only in terms of holding a canister containing a caulking material and the stirring or refilling of same, this does not preclude the use of the subject apparatus for a variety of other applications which will become obvious to those in situations requiring a hands-free stabilization of a canister including but not limited to painting preparation, wallpapering or the like.

Figure 7:
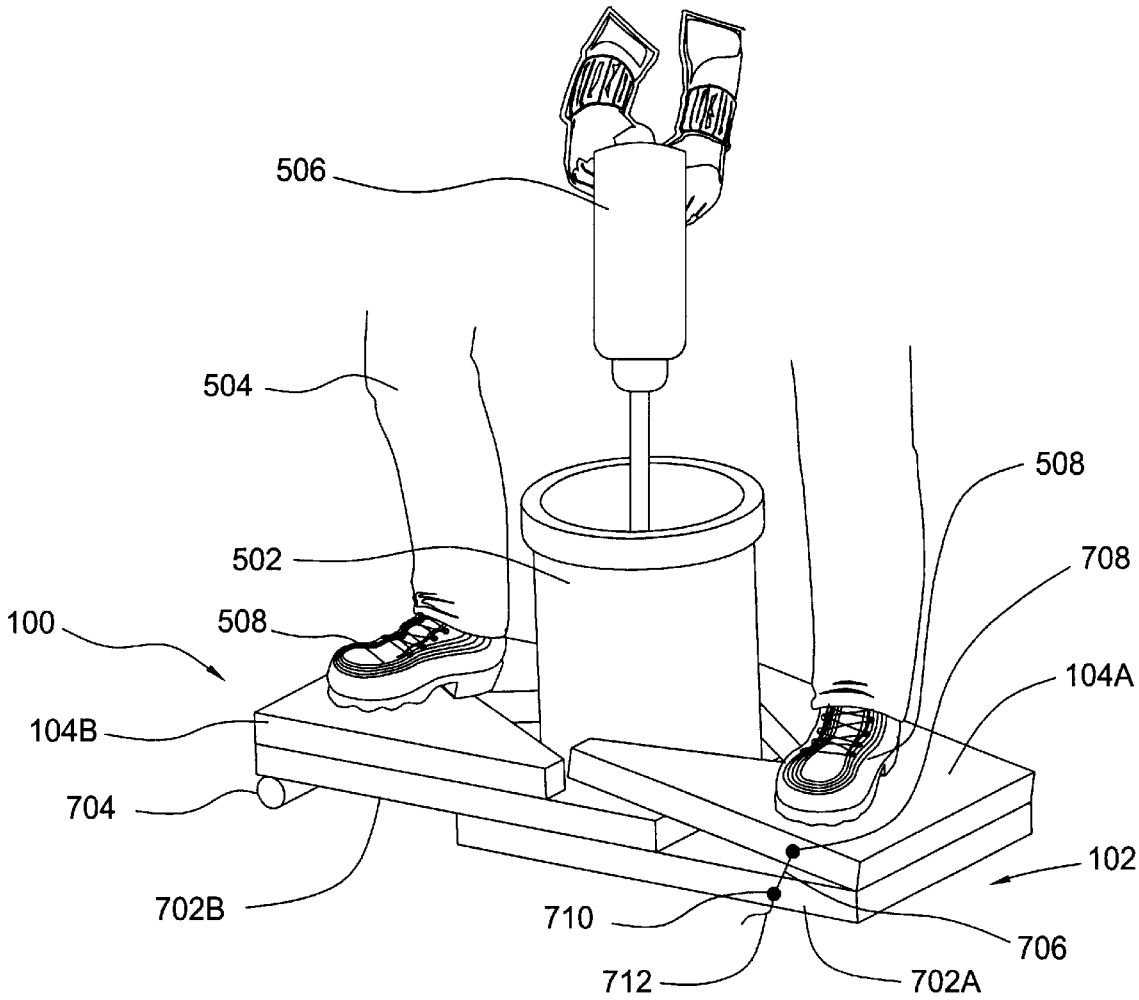
FIG. 7 is a partial front perspective view of a second alternate embodiment of the subject invention in use.
Figure 8:
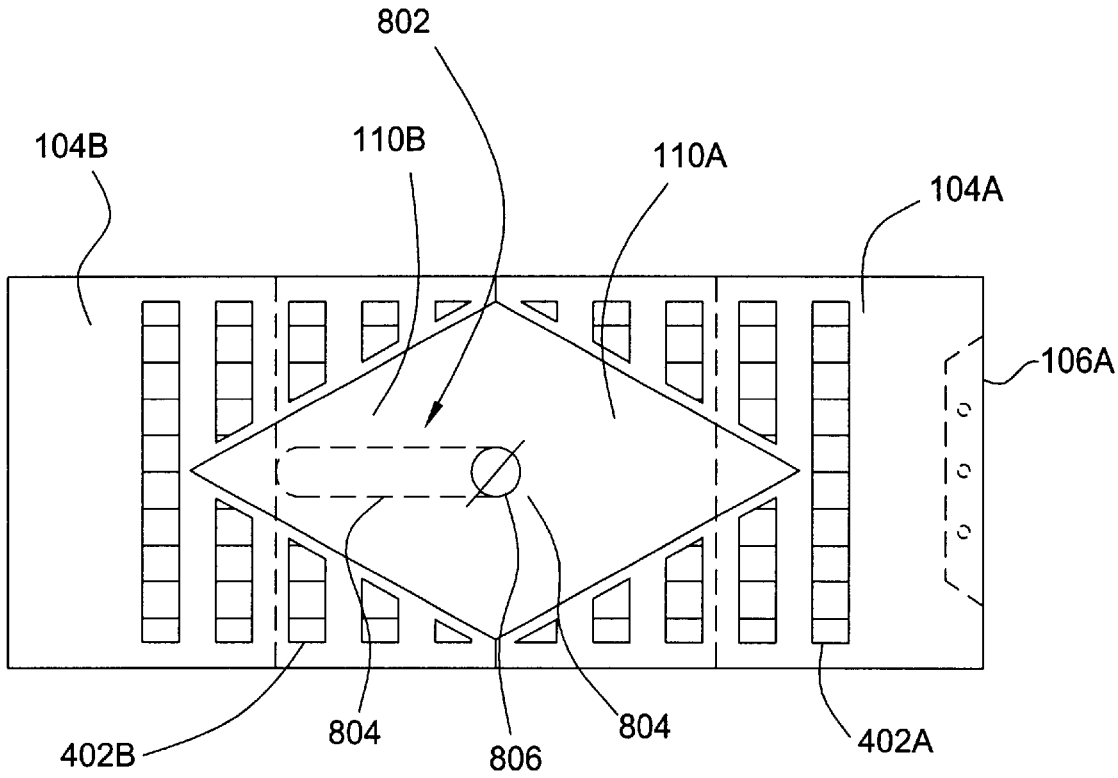
FIG. 8 is a top view of the alternate embodiment of the subject invention.
Figure 9:
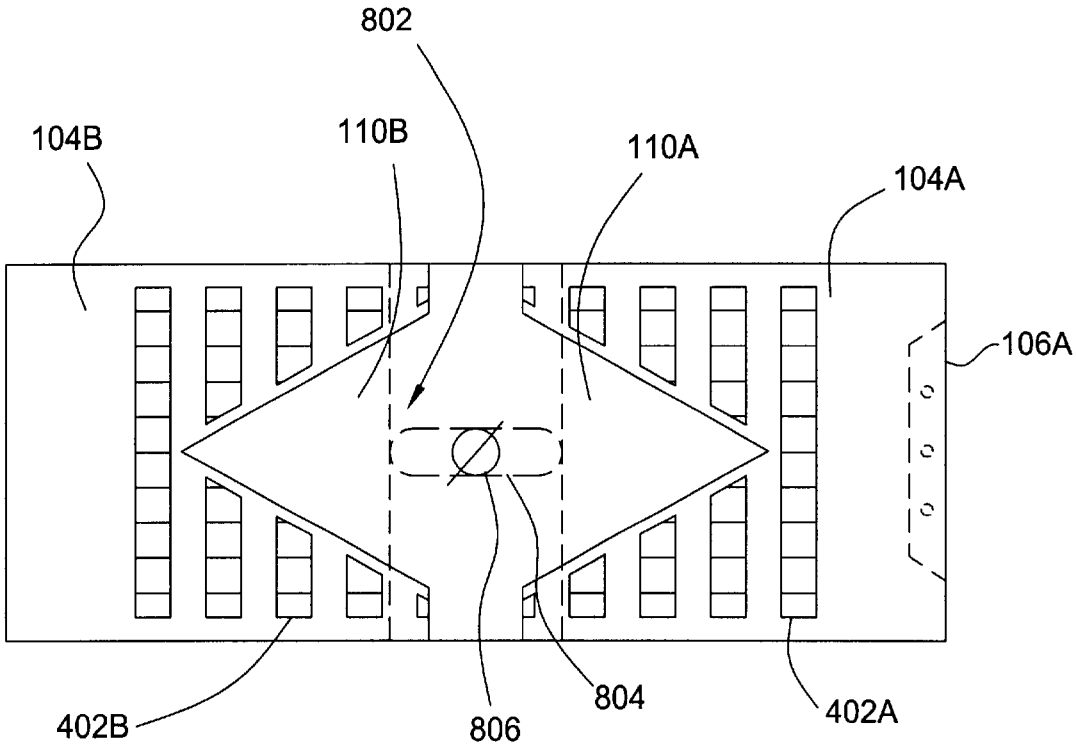
FIG. 9 is a top view of the alternate embodiment of the subject invention n an extended position.

FIG. 7 depicts a perspective view and FIG. 8 depicts a top view of an additional embodiment. These figures should be viewed concurrently while referring to this written description. Specifically, in this embodiment, the base member 102 further comprises a first base part 702A and a second base part 702B. The first base part 702A and a second base part 702B overlap each other and are connected by an expansion adjuster 802. The expansion adjuster 802 allows the first base part 702A and a second base part 702B to be slidably coupled to each other. In this way, vessels of various sizes (i.e. different diameter cans) can be accommodated by the apparatus 100. Preferably, the expansion adjuster 802 further comprises a slot 804 in one of the base parts (i.e. the first base part 702A) and a securing means 806 in the other base part (i.e., a bolt/wingnut combination passing through a bore (not shown) in the second base part 702B. As such, the base 102 is adjustable so that the movable swing member 104A will close upon various size vessels. Since the first base part 702A and second base part 702B overlap, there will be an unevenness when the apparatus 100 is place on the floor. To compensate, a leg 704 is provided under the second base part 702B. Moveable swing member 104A is also adjustable. That is, the spring loaded hinge 106A imparts a certain force that keeps the moveable swing member 104A open. However, an adjuster 706 is connected to the moveable swing member 104A and the base 102. In a preferred embodiment, a flexible wire is secured to a swing member anchor point 708 and to a base anchor point 710. Excess wire 712 is provided so that the moveable swing member 104A can swing further open if desired or necessary.

Figure 10:
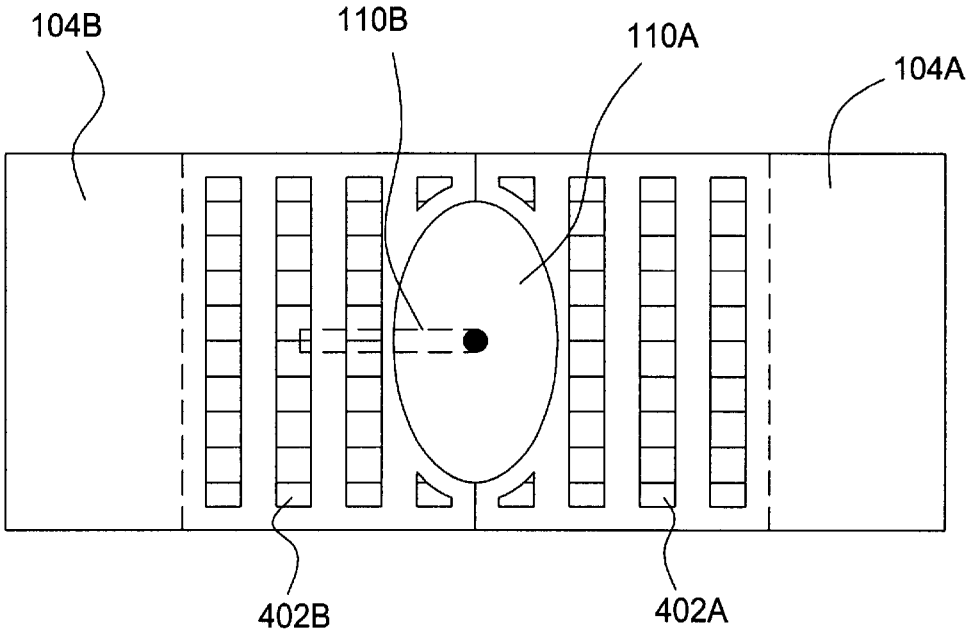
FIG. 10 is a top view of a third alternate embodiment of the subject invention.
Figure 11:
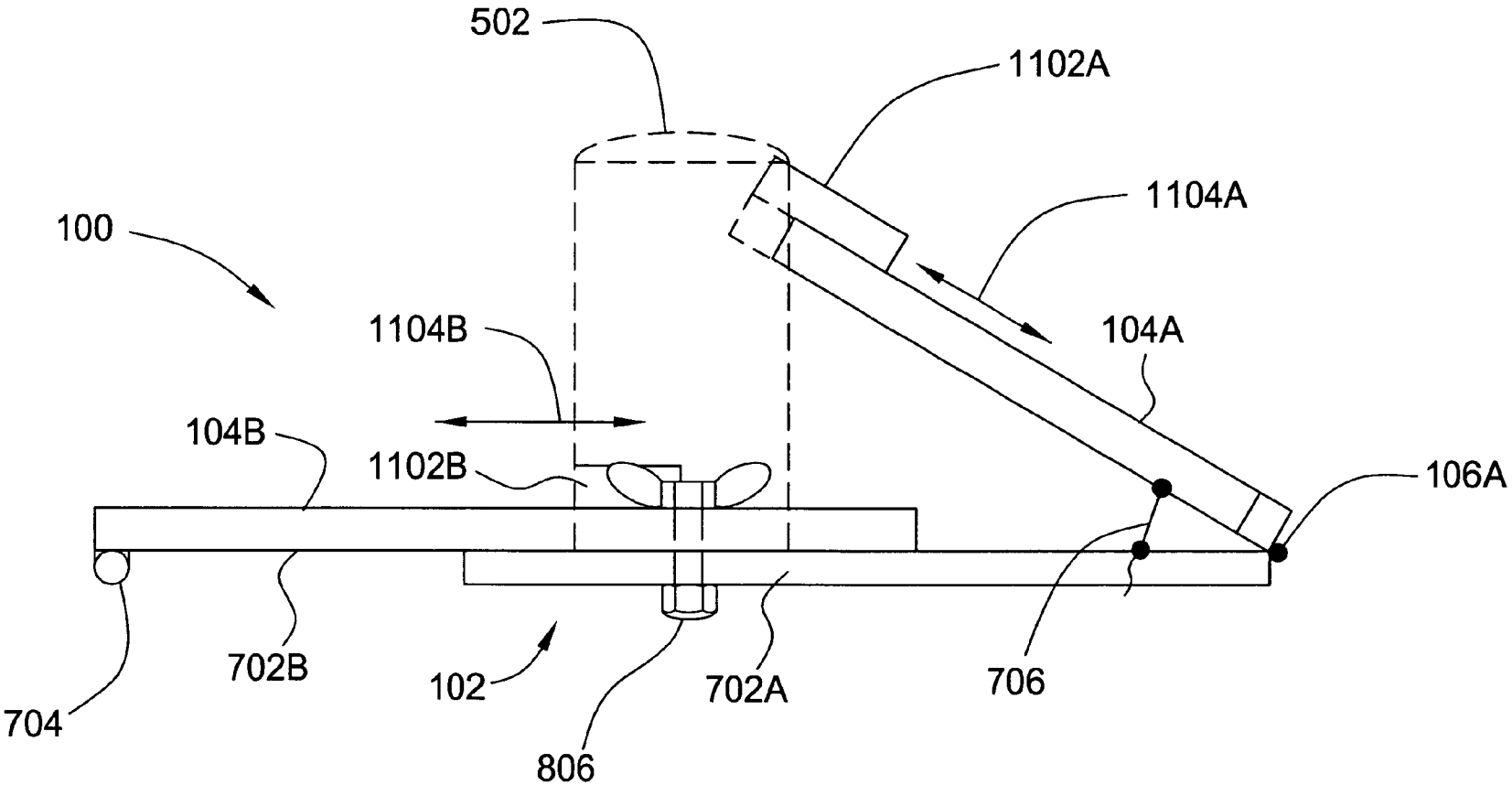
FIG. 11 is an elevation view of a fourth alternate embodiment of the subject invention.

Yet another embodiment of the apparatus is depicted in FIG. 11. Specifically, FIG. 11 depicts an elevation view of the apparatus 100 having adjustable flanges 1102A and 1102B on the ends of the moveable swing member 104A and stationary swing member 104B respectively. In such an embodiment the base 102 can be comprised of a single member (as in the embodiment of FIG. 1) or can be comprised of two members (as in the embodiment shown in FIG. 7 permanently affixed via securing means 806 or the like). At the end of the moveable swing member 104A, the adjustable flange 1102A has a range of motion depicted by arrows 1104A that allows for a larger cutout 110A (not seen in FIG. 11). Similarly, at the end of the stationary swing member 104B, the adjustable flange 1102B has a range of motion depicted by arrows 1104B that allows for a larger cutout 110B (not seen in FIG. 11). The flange can be made adjustable by any means known to those skilled in the art such as by sliding tracks and set screws, a single bolt and wingnut combination similar to that shown for the adjustability of the base 102 in FIGS. 7–10 or the like. A vessel 502 that is retained by the apparatus 100 is shown in phantom for increased understanding of the apparatus 100 and should not be construed as part of the invention here or in any of the previous FIGS displaying same vessel 502.

In operation, for larger vessels, the expansion adjuster 802 is opened (see FIG. 9) and resecured to a more beneficial setting. That is, larger vessels will cause the moveable swing member 104A to stop at an angle of incline that may cause the operator 504 to lose balance. Effectively widening the base 102 allows the moveable swing member 104A to come to rest nearly level with the base 102 and pinch the vessel in place. This condition allows the operator 504 to apply more downward pressure on the apparatus 100 to more securely retain a vessel 502 and to do so more comfortably and reliably.

Returning to FIG. 8, the cutouts 110A of moveable swing member 104A and 110B of stationary swing member 104B are triangular in shape. In this manner, a vessel (not shown) is clamped at two tangential points (one on either side of the triangle) rather than being completely held about the vessel's circumference. The triangular openings also facilitates the clamping of various size vessels. This feature in conjunction with the adjustable base 102 provides for clamping of various size vessels with minimal disruption of operator's tasks and increased reliability and comfort of operation of the apparatus 100. Although the cutouts 110A and 110B have been described as semicircular and triangular, this does not preclude other cutout shapes for retaining the vessel 502. For example, another embodiment of the apparatus has reduced arc length cutouts. In other words, the cutouts are semicircular in shape, but are not fully semicircular. FIG. 10 depicts swing members 104A and 104B having such reduced arc length cutouts (e.g. approximately 30% reduced from fully semicircular. Also in the embodiments of FIGS. 8, 9 and 10, the textured surface of the swing members are shown as louvers 402A and 402B that are stamped into the material (i.e., sheet metal) of the swing members 104A and 104B respectively.

Although various embodiments which incorporate the teachings of the present invention have been shown and described in detail herein, those skilled in the art can readily devise many other varied embodiments that still incorporate these teachings.

What is claimed is:

1. An apparatus for retaining a canister comprising:

an adjustable base;

at least one swing member attached to said base;

a spring member disposed upon said base and in contact with said swing member; wherein said swing member further comprises a first end and a second end; the first end of said swing member is rotatably attached to said base via a hinge member and the second end has a triangular recess.

2. The apparatus of claim 1 wherein said adjustable base further comprises a first base part and a second base part adjustably coupled together.

3. The apparatus of claim 2 wherein said first base part and said second base part are adjustably coupled via an expansion adjuster attached to one of the base parts and received by the other base part.

4. Apparatus for retaining a canister comprising:

an adjustable base;

at least one swing member attached to said base;

a spring member disposed upon said base and in contact with said swing member; wherein said swing member has a textured surface and the textured surface is comprised of louvers formed in the swing member.

* * * * *